US007140471B2

(12) United States Patent
Studhalter

(10) Patent No.: US 7,140,471 B2
(45) Date of Patent: Nov. 28, 2006

(54) ELEVATOR SHAFT CLOSURE AND METHOD OF FULFILLING FIRE PROTECTION REQUIREMENTS OF AN ELEVATOR SHAFT CLOSURE AND OF MOUNTING THE SAME

(75) Inventor: Ernst Studhalter, Lucerne (CH)

(73) Assignee: Inventio AG, Hergiswil NW (CH)

( * ) Notice: Subject to any disclaimer, the term of this patent is extended or adjusted under 35 U.S.C. 154(b) by 295 days.

(21) Appl. No.: 10/772,852

(22) Filed: Feb. 5, 2004

(65) Prior Publication Data

US 2005/0098388 A1 May 12, 2005

(30) Foreign Application Priority Data

Feb. 6, 2003 (EP) ..... 03002498

(51) Int. Cl.
*B66B 13/24* (2006.01)

(52) U.S. Cl. ..... 187/336; 187/333; 187/340

(58) Field of Classification Search ..... 187/336, 187/340, 333; 52/232; 49/DIG. 21
See application file for complete search history.

(56) References Cited

U.S. PATENT DOCUMENTS 5,156,237 A * 10/1992 Hayashi et al. ..... 187/333
5,404,969 A 4/1995 Hoefsloot
5,836,424 A * 11/1998 Allen ..... 187/333
5,988,321 A 11/1999 Kondo
6,539,673 B1 * 4/2003 Ketonen ..... 52/30
2003/0167709 A1 * 9/2003 Harkins et al. ..... 52/204.1

FOREIGN PATENT DOCUMENTS

GB 2148993 A * 6/1985
GB 2 352 754 4/1992
GB 2309729 A * 8/1997
GB 2352754 A * 2/2001
JP 08 165081 6/1996

OTHER PUBLICATIONS

Expert Committee, "Vereinigung der Technischen Überwachungsvereine" May 5, 1999, Berlin.

* cited by examiner

*Primary Examiner*—Kathy Matecki
*Assistant Examiner*—Terrell Matthews
(74) *Attorney, Agent, or Firm*—Butzel Long

(57) ABSTRACT

An elevator shaft closure and a method of fulfilling fire protection requirements for the same include a shaft door frame having in the region of the closing edge of the frame with a door leaf of at least two door frame parts attached to a building and connected together with a thermally separable material. Under a predetermined stress, the connection between the door frame parts is released and one of the door frame parts displaces in front of the door leaf while the other door frame part substantially retains its original shape.

9 Claims, 3 Drawing Sheets

FIG. 5
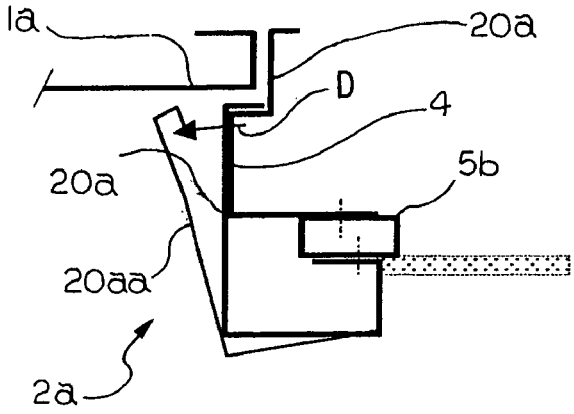
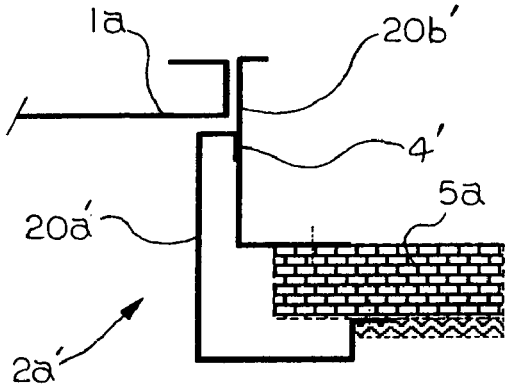
FIG. 6
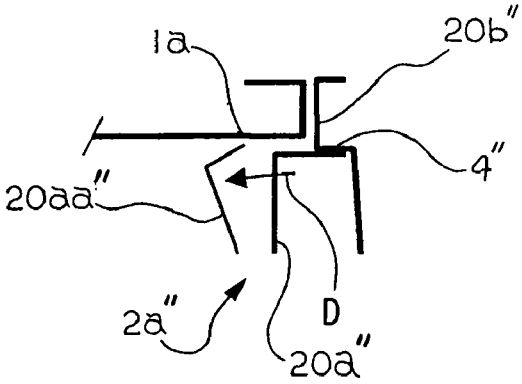
FIG. 7

ELEVATOR SHAFT CLOSURE AND METHOD OF FULFILLING FIRE PROTECTION REQUIREMENTS OF AN ELEVATOR SHAFT CLOSURE AND OF MOUNTING THE SAME

BACKGROUND OF THE INVENTION

The present invention relates to an elevator shaft closure, which is preferably used for elevator installations with fire protection requirements as are demanded in known Standards such as BS476, UL10B or DIN4102.

The elevator shaft closure enables access from the floor to the car. It consists of the principal parts of a door frame and at least one door leaf. The door frame is alternatively connected, depending on the type of building, directly with a wall or on a foundation frame. At least one door leaf is slidably mounted in the door frame. Depending on the possible forms of arrangement of the door leaves distinction is then made between single-leaf or multi-leaf telescopic doors or center doors. Telescopic doors close and open on one side, whereas center doors open and close at both sides from or towards the center or middle of the door opening.

In the case of the closed elevator shaft closure with telescopic doors, the closing-side door leaf together with the closing-side door frame forms a closing edge region. The closing edge region is usually formed as a labyrinth, as is described in, for example, the transcript of the "Vereinigung der Technischen Überwachungsvereine" expert committee of the 12th sitting of May 5, 1999 (Berlin).

In this elevator shaft closure the problem is of distortion of the closing-side door frame when acted on, in accordance with the Standard, by fire and the thereby defined thermal stress. This distortion has the consequence that the closing-side door leaf is forced away and consequently a larger gap, which is not acceptable according to the Standard, results. In the Standard requirement according to BS476, part 20 (Integrity), for example, a permissible maximum gap size of 6 millimeters is defined.

Usual present-day solutions counteract this distortion and the resulting forcing away of the door leaf by the closing-side door frame being connected by stiff connecting supports with the wall or by the labyrinth depth being formed to be appropriately deep, partly greater than 35 millimeters. These solutions are expensive in production and assembly or they have a non-aesthetic effect.

UK patent document GB-A-2352754 shows a smoke sealing element in the form of brushes which seal the gap between the door leaf and the door frame. The object of this gap seal is to prevent propagation of cooled down smoke in the building. This solution fails in the case of direct exposure of the elevator doors to flame, as is given in the case of fire in the immediate vicinity of the access to the elevator shaft closure. The brushes melt or burn away and the elevator shaft closure is deformed under the influence of thermal loading in such a manner that large door gaps arise, whereby the risk of fire propagation in the elevator shaft and thus also in other floors is increased.

SUMMARY OF THE INVENTION

The present invention is based on the object of proposing an elevator shaft door for telescopic doors which ensures that, in the case of fire, unacceptably large gap openings do not arise due to the effect of heat. The shaft door according to the present invention shall eliminate the disadvantages arising from the usual present-day solutions explained above.

In the case of an elevator shaft closure for a telescopic door, a closing-side door leaf together with a closing-side door frame forms, in a closed state, a closing edge region. According to the present invention, the door frame is constructed to be multi-part in the closing edge region. At least one door frame part at least partly changes its position relative to another door frame part under defined thermal stress. The door frame parts are independently fastened to the wall or a foundation construction to be thermally separate from one another or thermally separable from one another. The advantage of the present invention resides particularly in the fact that in the case of fire a part of the door frame can displace in front of the door leaf by the thermal stress defined by the fire without in that case forcing away the door leaf. The labyrinth depth can be formed to be correspondingly small in the closing edge region. This enables aesthetic and space-saving solutions.

The two door frame parts advantageously form a labyrinth. The separation of the two parts is preferably disposed at an edge defined by the labyrinth. Due to this constructional solution the gap formation is reduced and a beneficially aesthetic shape results.

In an advantageous construction according to the present invention, the two door frame parts are fastened directly to the walling or to a foundation frame. This enables an economic and assembly-optimized solution in correspondence with the type of building.

The thermal separability is advantageously achieved by the fact that the two parts are held together by, for example, plastic material rivets or adhesive, or that the two parts are pressed together by bias of the fastening. These forms of construction form economic methods, which are non-critical in processing, of connection of the two door frame parts. In addition, replacement of the individual part is possible in the case of damage. Moreover, the two parts can be fixedly joined together in the non-thermally loaded lower and upper regions of the door frame part. This fastening relieves the thermally separable connection of the load due to operation and thus prevents damage in the case of stronger loading.

In accordance with present invention proposal the two door frame parts can consist of different materials. This enables aesthetic solutions corresponding with customer wish.

Overall, the advantages achieved by the present invention are that in the case of fire a part of the door frame can displace in front of the door leaf without the door leaf itself in that case being pushed away, and the second part of the door frame, due to the fact that it is thermally separately guided on the foundation frame or the walling, exerts a significantly reduced pressure on the door leaf, whereby unacceptably large gap openings in the closing edge region do not result.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 5 is a cross-sectional view similar to FIG. 3 showing an elevator shaft closure according to the present invention connected to a foundation upright, and schematically showing the characteristic behavior in the case of fire;

FIG. 6 is a view similar to FIG. 5 showing the elevator shaft closure according to the present invention connected with a building wall; and FIG. 7 is a view similar to FIG. 5 showing a possible form of the separating location of the two closing-side door frame parts.

DESCRIPTION OF THE PREFERRED EMBODIMENT

Figure 1:
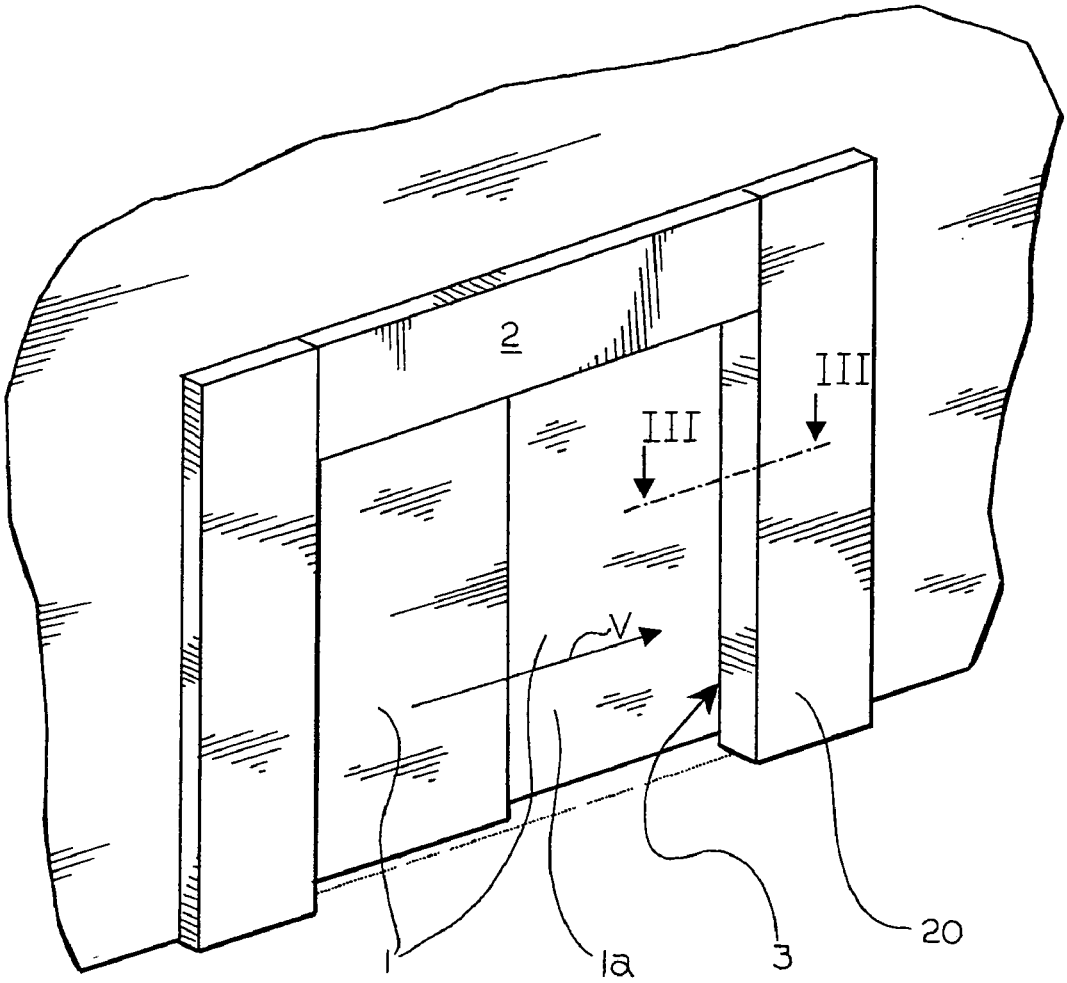
FIG. 1 (PRIOR ART)
FIG. 1 is a perspective view of a known elevator shaft closure for a telescopic door with two door leaves.
Figure 2:
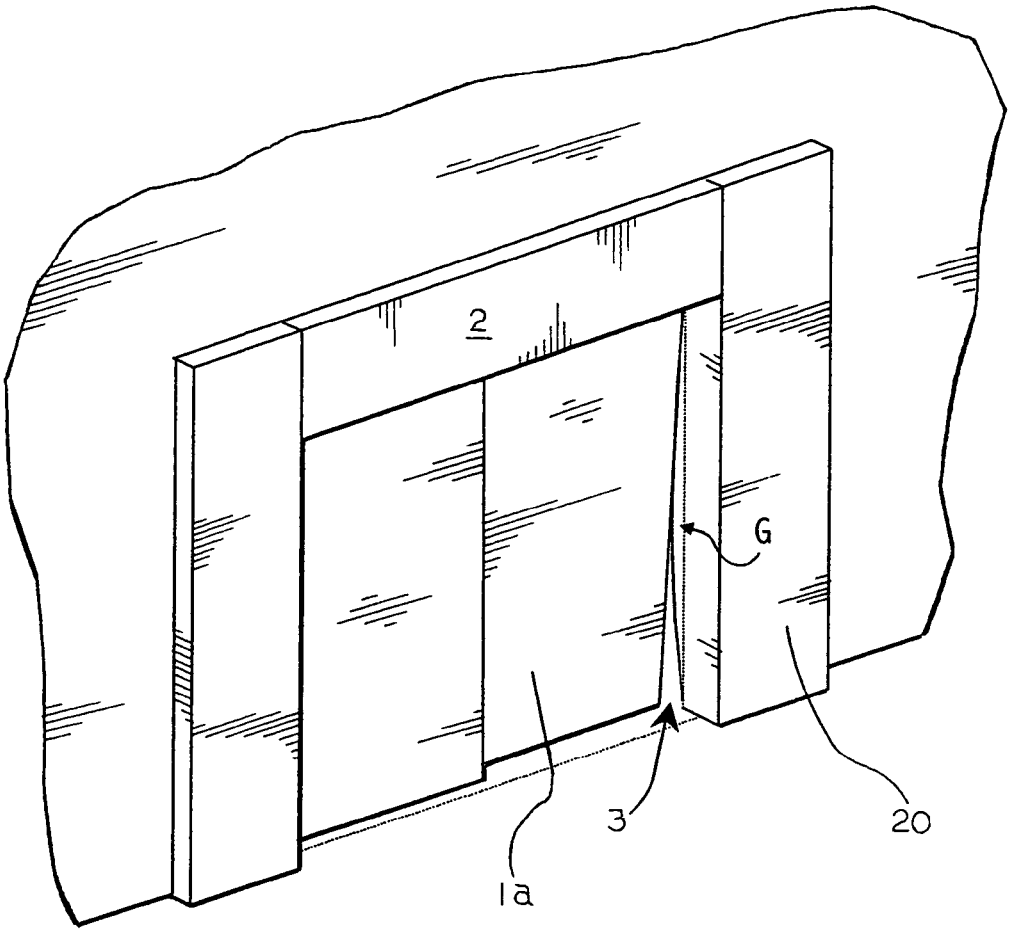
FIG. 2 (PRIOR ART)
FIG. 2 is a view similar to FIG. 1 showing a characteristic behavior of the closure in the case of fire.
Figure 3:
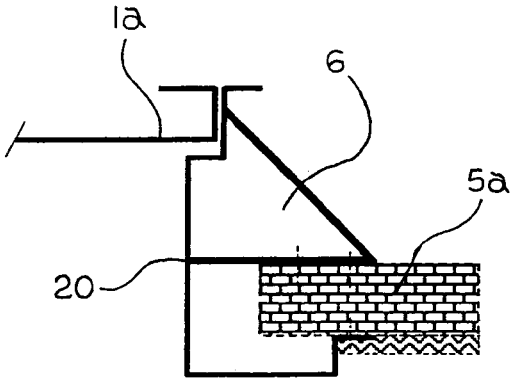
FIG. 3 (PRIOR ART)
FIG. 3 is an enlarged cross-sectional view taken along the line III—III in FIG. 1 showing the currently known stiff wall connection.
Figure 4:
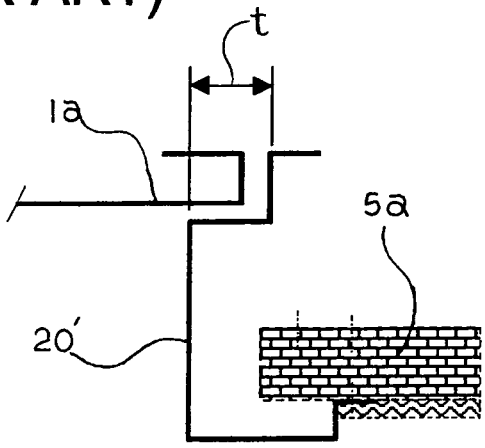
FIG. 4 (PRIOR ART)
FIG. 4 is a view similar to FIG. 3 showing a currently known alternative connection with a large labyrinth depth "t"

There is shown in FIGS. 1 and 2, a known elevator shaft closure 1 mounted in a door frame 2 mounted in an elevator shaft opening of a building. In FIGS. 1–7, a closing-side door leaf of the elevator shaft closure 1, for single-leaf (not shown) or multi-leaf (shown) telescopic doors is denoted by 1*a*. A part of the door frame 2 forming a closing edge region 3 (FIGS. 1 and 2) is denoted by 20 (FIGS. 1–3) or 20' (FIG. 4). In FIGS. 5–7, a door frame 2*a* (2*a*' and 2*a*") according to the present invention has a closing edge 20*a*, 20*b* (20*a*', 20*b*' and 20*a*", 20*b*"). An arrow V (FIG. 1) represents a closing direction of the door leaf 1*a* toward the closing edge region 3. A wall of a building in which the elevator is installed in denoted by 5*a* (FIGS. 3, 4 and 6) and a foundation upright of the building is denoted by 5*b* (FIG. 5). In FIG. 3, a brace or support 6 is used to stiffen the closing edge part 20.

One possible mode of construction of the shaft door closure according to the present invention is illustrated in FIG. 5. The closing-side or edge of the door frame 2*a* consists the two door frame parts 20*a* and 20*b* which are connected together at the joint location by a thermally separable connection 4. The first frame part 20*a* is fastened to the illustrated foundation upright or post 5*b*. The second door frame part 20*b* is similarly fastened to the foundation upright 5*b*. Together they form the overall unit of the closing-side door frame.

In the event of fire the thermally separable connection 4 loses its connecting force due to the arising heat. As a consequence, the first door frame part 20*a* can freely deform in a direction denoted by an arrow D to a deformed position 20*aa* in correspondence with the thermal stress forces without thereby forcing the door leaf 1*a* away. The second door frame part 20*b* is now protected by the first door frame part 20*a* in the deformed position 20*aa* from direct heat radiation. It correspondingly deforms only slightly and thereby exerts a reduced pressure on the door leaf 1*a*. Moreover, a gap which possibly arises is in addition covered by the pushed-forward first door frame part 20*a* in the position 20*aa*.

The closing edge of the door frame 2*a* (2*a*', 2*a*") according to the present invention is advantageously constructed as a labyrinth, whereby an aesthetic solution is created. FIG. 6 and FIG. 7 show alternate constructional forms of execution of the labyrinth and the connecting location of the two door frame parts 20*a*' (20*a*") and 20*b*' (20*b*").

Depending on the mode of construction of the building the need for a foundation post 5*b* (FIG. 5) may be redundant. The second door frame part 20*b* can accordingly be mounted on the foundation upright 5*b* or alternatively the second door frame part 20*b*' fastened directly to the wall 5*a*, depending on the type of building. The thermally separable connection 4 (4, 4) connects the two door frame parts 20*a* (20*a*', 20*a*") and 20*b* (20*b*', 20*b*") respectively. As presented, this connection is effected by plastic material rivets. Alternative connecting solutions such as adhesive, or by pressing the two door frame parts together by bias of the fastening members, can selectably be used. The selection of the method of connection is carried out in dependence on the design of the installation. This enables a cost-optimized production by making production methods flexible.

For repair or for cost-optimized production, thermally fixed connections are possible in the upper and/or lower door post region. The two frame parts 20*a* (20*a*', 20*a*") and 20*b* (20*b*', 20*b*") can consist of different materials such as, for example, chromed steel and painted sheet steel. This provides an additional aesthetic benefit.

With knowledge of the present invention the expert can change the set shapes and arrangements as desired. For example, the illustrated door frame shape and/or door frame dimension can be changed in correspondence with the purpose.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator shaft closure for a telescopic door having at least one door leaf and a door frame, a closing edge region being formed in a closed state by the at least one door leaf and a closing edge of the door frame, comprising:

a first door frame part and a second door frame part in the closing edge region cooperating to form the closing edge of the door frame, said first and second door frame parts adapted to be attached to a building at an elevator door opening; and a thermally separable material connecting said first door frame part to said second door frame part whereby said thermally separable material releases said first door frame part from said second door frame part and said first door frame part changes position relative to said second door frame part under predetermined thermal stress.

2. The elevator shaft closure according to claim 1 wherein said first door frame part and said second door frame part are configured to form a labyrinth.

3. The elevator shaft closure according to claim 1 wherein said first door frame part and said second door frame part are configured to be selectably fastened to one of a wall of the building and a foundation upright of the building.

4. The elevator shaft closure according to claim 3 wherein said thermally separable material detachably connects said first door frame part with said second door frame part in the closing edge region.

5. The elevator shaft closure according to claim 4 wherein said first door frame part and said second door frame part are additionally firmly fixedly connected in at least one of an upper portion and lower portion of the closing edge region.

6. The elevator shaft closure according to claim 1 wherein said first door frame part and said second door frame part are formed of different materials.

7. A method of fulfilling fire protection requirements in an elevator shaft closure for a door with a least one door leaf comprising the steps of:

a) attaching a first door frame part to a a building at the elevator door opening;

b) attaching a second door frame part to the building at the elevator door opening to form a closing edge of a door frame with the first door frame part; and c) connecting the first door frame part to the second door frame part with a thermally separable material whereby the thermally separable material releases the first door frame part from the second door frame part and the released forst door frame part changes posititon relative to the second door frame part under predetermined thermal stress.

8. The method according to claim 7 wherein said steps a) and b) are performed by attaching the first and second door frame parts to one of a wall of the building and a foundation upright of the building.

9. An elevator shaft closure for a telescopic door having at least one door leaf and a door frame, a closing edge region being formed in a closed state by the at least one door leaf and closing edge of the door frame, comprising:

a first door frame part and a second door frame part in the closing edge region cooperating to form the closing edge of the door frame, said first and second door frame parts adapted to be attached to a building at an elevator door opining; and a thermally separable material connecting said forst door frame part to said second door frame part wherby when the elevator shaft closure is installed in the door opening, said thermally separable material releases said first door frame part from said second door frame part under predtermined thermal stress and said first door frame part displaces in front of the a least one door leaf and said second dooor frame part substantially retains its original shape.

* * * * *